United States Patent [19]

Matsuo et al.

[11] Patent Number: 4,963,892

[45] Date of Patent: Oct. 16, 1990

[54] MICROWAVE PLANE ANTENNA WITH TWO ARRAYS WHICH HAVE BEAMS ALIGNED IN THE SAME DIRECTION

[75] Inventors: Masayuki Matsuo, Kobe; Toshio Abiko; Yoshiaki Ueno, both of Ibaraki; Minoru Kanda, Shijonawate, all of Japan

[73] Assignee: Matsushita Electric Works, Ltd., Osaka, Japan

[21] Appl. No.: 336,537

[22] Filed: Apr. 12, 1989

Related U.S. Application Data

[63] Continuation of Ser. No. 754,989, Jul. 15, 1985, abandoned.

[30] Foreign Application Priority Data

Jul. 13, 1984 [JP] Japan ..... 59-145291
Jul. 13, 1984 [JP] Japan ..... 59-145293

[51] Int. Cl.[5] ..... H01Q 13/08
[52] U.S. Cl. ..... 343/700 MS; 343/731
[58] Field of Search ..... 343/700 MS File, 731, 343/846, 848, 849, 829, 830; 333/128, 136, 246

[56] References Cited

U.S. PATENT DOCUMENTS

| | | | |
|---|---|---|---|
| 4,021,810 | 5/1977 | Urpo et al. | 343/731 |
| 4,051,478 | 9/1977 | Kaloi | 343/700 MS |
| 4,335,385 | 6/1982 | Hall | 343/700 MS |
| 4,356,462 | 10/1982 | Bowman | 333/128 |
| 4,398,199 | 8/1983 | Makimoto et al. | 343/700 MS |
| 4,475,107 | 10/1984 | Makimoto et al. | 343/700 MS |

FOREIGN PATENT DOCUMENTS

| | | | |
|---|---|---|---|
| 99803 | 6/1982 | Japan . | |
| 125901 | 7/1983 | Japan | 343/700 MS |

*Primary Examiner*—Eugene R. LaRoche
*Assistant Examiner*—Benny T. Lee
*Attorney, Agent, or Firm*—Burns, Doane, Swecker & Mathis

[57] ABSTRACT

A microwave plane antenna including rows comprising pairs of parallel conductive line antenna elements configured as a pair of out-of-phase square waves and a signal feed circuit of strip lines arranged as a corporate feed network. The respective conducting paths which run from a main feed inlet end of the circuit to each signal receiving end of the respective elements being varied in length, so that the main beam direction can be set in a plane including that of the antenna and normal to lengthwise axis of the antenna elements for a remarkable increase in the reception gain.

2 Claims, 3 Drawing Sheets

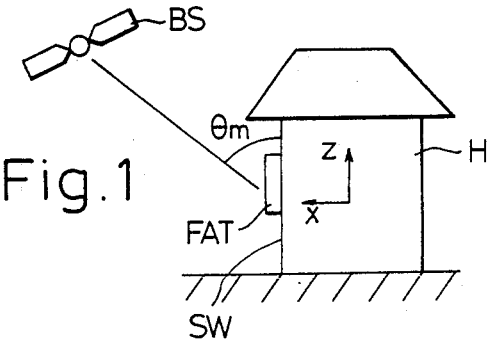
Fig.1
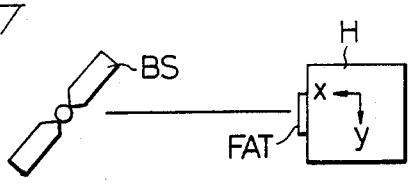
Fig. 2a
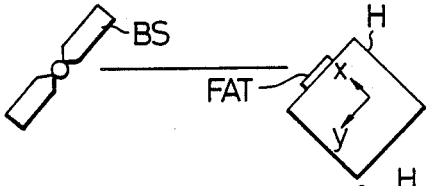
Fig. 2b
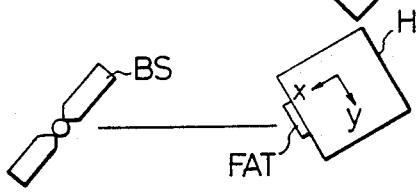
Fig. 2c
Fig. 4a
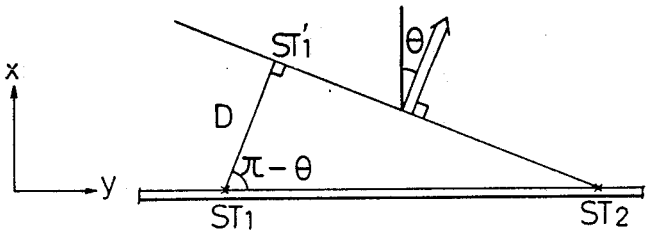
Fig.4b
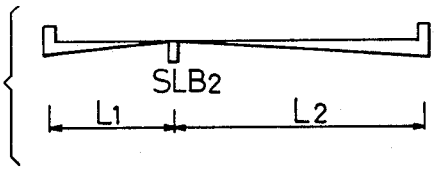

MICROWAVE PLANE ANTENNA WITH TWO ARRAYS WHICH HAVE BEAMS ALIGNED IN THE SAME DIRECTION

This application is a continuation of application Ser. No. 06/754,989, filed July 15, 1985, abandoned.

TECHNICAL BACKGROUND OF THE INVENTION

This invention relates to a microwave plane antenna for receiving circularly polarized waves.

The microwave plane antenna of the type referred to is effective to receive circularly polarized waves which are transmitted as carried on SHF band, in particular 12 GHz band, from a geostationary broadcasting satellite launched into cosmic space 36,000 Km high from the earth.

DISCLOSURE OF PRIOR ART

Geostationary satellite broadcastings have been put into practice in recent years. The electromagnetic waves transmitted from the satellite are circularly polarized waves and, specifically, such waves transmitted from a Japanese broadcasting satellite launched above the equator and received in Japan are righthanded.

Antennas generally used by listeners for receiving such circularly polarized waves are parabolic antennas erected on the roof or the like position of house buildings. However, the parabolic antenna involves certain shortcomings, e.g., its configuration and mounting structure are complicated to render its manufacturing cost to be rather high, it is susceptible to being toppled by strong wind due to its bulky structure so that an additional means for stably supporting the antenna will be necessary. Such supporting means further requires such troublesome work as a fixing to the antenna of reinforcing pole members forming a major part of the supporting means, which may be more costly than the antenna itself.

In attempt to eliminate these problems involving the parabolic antenna, there has been disclosed in Japanese Patent Appln. Laid-Open Publication No. 99803/1982 (corresponding to U.S. Pat. No. 4,475,107 or to German Offenlegungsschrift No. 3149200) a planar antenna of flattened configuration, so that the antenna can be simplified in structure to render it inexpensive and mountable directly on a wall surface of buildings, eliminating the necessity of any additional supporting means to reduce required cost for the mounting.

More in detail, this plane antenna comprises antenna elements arranged in a plurality of rows, each of which elements comprises a pair of parallel microstrip conductor lines configured as a pair of out-of-phase square waves. There is thus formed a so-called one-dimensional array antenna of traveling wave type having a frequency characteristic and directivity determined by the manner in which the micro-strip line conductors are shaped, i.e., the frequency of the "square-wave" shaped conductors. Assuming here that the micro-strip lines are of a negligible width and connected to a power source for a uniform flow of traveling-wave current through the lines, then the directive characteristics in the x-z plane of the antenna can be calculated by obtaining conditions for radiating the circularly polarized waves in the main beam direction $\theta_m$, the radiating conditions themselves for the circularly polarized wave being able to be expressed by following equations:

$$b + (1 - \eta\cos\theta_m)\,2a = \lambda g\left\{1 \mp \frac{1}{\pi}\,\mathrm{Tan}^{-1}(\sin\theta_m/1 - \eta\cos\theta_m)\right\} \quad (1)$$

$$b + (1 - \eta\cos\theta_m)\,c = \lambda g\left\{1 \pm \frac{1}{\pi}\,\mathrm{Tan}^{-1}(\sin\theta_m/1 - \eta\cos\theta_m)\right\} \quad (2)$$

where $\theta_m$ denotes the main beam direction, "a", "b" and "c" are the lengths of the leg side, lateral side and central side, respectively, of such square wave shape of the microstrip line as shown in FIG. 3, $\eta$ is the wavelength shortening coefficient of the micro-strip line, $\lambda g$ is the line wavelength of the micro-strip line the upper "−" sign of the double signs in the equation (1) or "+" sign in the other equation (2) denotes lefthanded circularly polarized waves, the lower "+" sign of the double signs in the equation (1) or "−" sign in the equation (2) denotes the righthanded circularly polarized waves, "x" axis is perpendicular to the plane antenna, "y" axis lies in the plane of the antenna and extends perpendicular to the lengthwise direction of the antenna elements, and "z" axis lies in the plane of the antenna and extends parallel to the lengthwise direction of the elements.

In the equations (1) and (2), values of $\theta_m$ and "b" properly selected and inserted into the equations will also determine values of "a" and "c", whereby the side length of the square wave shape can be determined, and a micro-strip line can be formed. A plurality of such micro-strip lines are provided in pairs, spatial phases of the micro-strip lines in each pair are made mutually different, and the square-wave shaped micro-strip lines are mutually staggered i.e. are out-of-phase for restraining the grating lobe of the radiation beam and sharpening its directivity. A plurality of rows of the antenna elements respectively comprising the pair of the micro-strip lines are provided on one surface of an insulating substrate of a Teflon glass fiber, polyethylene or the like and provided over the other surface with a ground conductor. Provided to one end side of the antenna element rows is a signal feed circuit which includes strip line conductors branched into a so-called corporate feed network to supply an electric power to the respective antenna elements in parallel and at the same amplitude and phase, while a termination resistor is inserted at the other ends of the antenna elements.

In the foregoing micro-strip line antenna, the main beam direction $\theta_m$ can be varied by changing the dimensions of the wave shape in the micro-strip lines or, in other words, the antenna can be provided with any desired directivity. As shown in FIG. 1, therefore, a micro-strip line antenna FAT mounted on a southward wall SW of a house building H can set the main beam direction $\theta_m$ in an x-z plane with respect to a geostationary broadcasting satellite BS for achieving the maximum gain of signal reception. The main beam direction $\theta_m$, that is, the incident angle of signal waves transmitted from the satellite depends on the terrestrial latitude of the antenna location, which is in the range of, for example, about 30° to 50° in Japan.

In the plane antenna FAT of the micro-strip lines, the micro-strips are perpendicular to the y axis in the x-y plane so that, when signal waves from the satellite BS are incident on the antenna FAT in the x axis direction and are thus vertical to the plane antenna as shown in FIG. 2(*a*), the antenna can attain a predetermined signal reception gain. When the signal waves from the satellite BS are not perpendicular to the plane antenna FAT in the x-y plane but are angled with respect to the x axis as shown in FIG. 2(*b*) or FIG. 2(*c*), however, there occurs a problem in that the signal reception gain drops remarkably. In other words, the main beam direction can be properly set in the x-z plane by changing the wave shape of the micro-strip lines but not in the x-y plane, whereby the main beam direction is not allowed to be settable in three-dimensions. For this reason, the plane antenna FAT has such a problem that, when the wall SW perpendicular to the incident signal wave is unavailable as in the case of FIG. 2(*b*) or (*c*), it has been unable to raise the signal reception gain.

To raise the signal reception gain, on the other hand, it may be effective to increase the number of micro-strip lines in the plane antenna and to extend them longer, but this measure is disadvantageous in narrowing the frequency band in the plane antenna of the foregoing arrangement. The suggestion of the above Japanese Publication has been an attempt to increase the number cf the strip lines without narrowing the frequency band by means of a provision of a pair of the micro-strip line antennas in parallel relation to each other. That suggestion involves still another problem in that, since the pair of micro-strip line antennas are parallel in a direction perpendicular to the longitudinal direction of the micro-strip lines as shown in FIGS. 14 and 15 of the Publication, the strip lines forming a common signal feed circuit for both antennas are so long as to increase the power loss in the circuit to such an extent that it is substantially impossible to increase the signal reception gain. More particularly, the strip lines of the signal feed circuit are generally printed on an insulating substrate, in which event the power loss in the strip lines of the signal feed circuit is determined depending on their length along the y axis, so as to be about 3 dB in the case of a signal feed circuit for the parallel plane antennas of a standard size. On the other hand, the signal reception gain obtained by the parallel plane antennas is increased by 3 dB with a doubled reception area in the case of such standard size as above. This increment in the signal reception gain obtained by the paired parallel provision of the antennas, however, has to be substantially cancelled by the loss in the signal feed circuit, and the suggested measure has been still defective in this respect.

TECHNICAL FIELD OF THE INVENTION

A primary object of the present invention is, therefore, to provide a plane antenna which can set the main beam direction of the antenna, i.e., the incident angle of signal waves from the geostationary broadcasting satellite, both in the x-y and x-z planes, so as to allow it possible to set the incident angle of the received signal waves freely in a three-dimensional zone, and can restrain any loss in the signal feed circuit even in a parallel provision of the paired plane micro-strip line antennas without narrowing the frequency band, whereby the total signal reception gain of the plane antenna can be raised to be closer to signal reception efficiency of the parabolic antenna which is known to achieve a signal reception gain of 65%.

According to the present invention, this object can be realized by providing a microwave plane antenna comprising a plurality of pairs of antenna elements respectively consisting of a pair of micro-strip lines of a conductor arranged in rows and configured as a pair of out-of-phase square waves, a signal feed circuit of strip conductor lines defining a corporate feed network connected to signal receiving ends of the antenna elements, and a termination resistor connected to the other ends of the antenna elements, wherein the strip lines of the signal feed circuit are made different in the length leading from a main feed inlet end of the circuit to signal receiving ends of the antenna elements so that the main beam inclination can be set in a plane including the plane of the antenna and perpendicular to an axis in lengthwise direction of the antenna elements; or a plane antenna comprising a pair of plane antenna parts respectively including the antenna elements arranged in rows, and a pair of the signal feed circuits for the paired antenna parts and connected together at their main feed inlet ends, wherein the paired plane antenna parts are provided in axial symmetry with respect to a line perpendicular to the longitudinal direction of the antenna elements, so that the signal feed circuits of the both antenna parts can be closely opposed to each other, and main beam directions of the antenna elements in both plane antenna parts can be made consistent to each other.

Other objects and advantages of the present invention shall be made clear in the following description of the invention detailed with reference to preferred embodiments shown in accompanying drawings.

BRIEF EXPLANATION OF THE DRAWINGS

FIG. 1 is a diagram for explaining the incident angle of signal waves transmitted from a geostationary broadcasting satellite to a plane antenna in the x-z plane, that is, a main beam direction of the plane antenna in the x-z plane;

FIGS. 2*a*, 2*b* and 2*c* depict different orientations of the main bear: direction within the x-y plane of the antenna;

FIG. 4*a* shows diagrammatically relationships between the main beam inclination and a strip line of the signal feed circuit in the plane antenna of FIG. 3;

FIG. 4*b* and 4*c* shows the different lengths between portions of conductive paths for two antenna elements;

Figure 7:
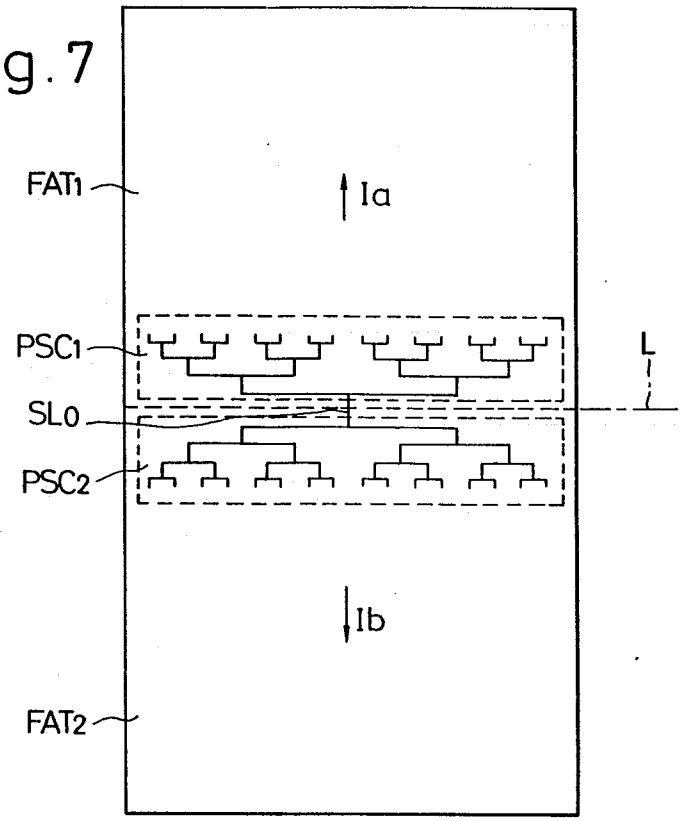
FIG. 7 shows in a plan view detailed pattern of the signal feed circuit in the embodiment of FIG. 5.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 3:
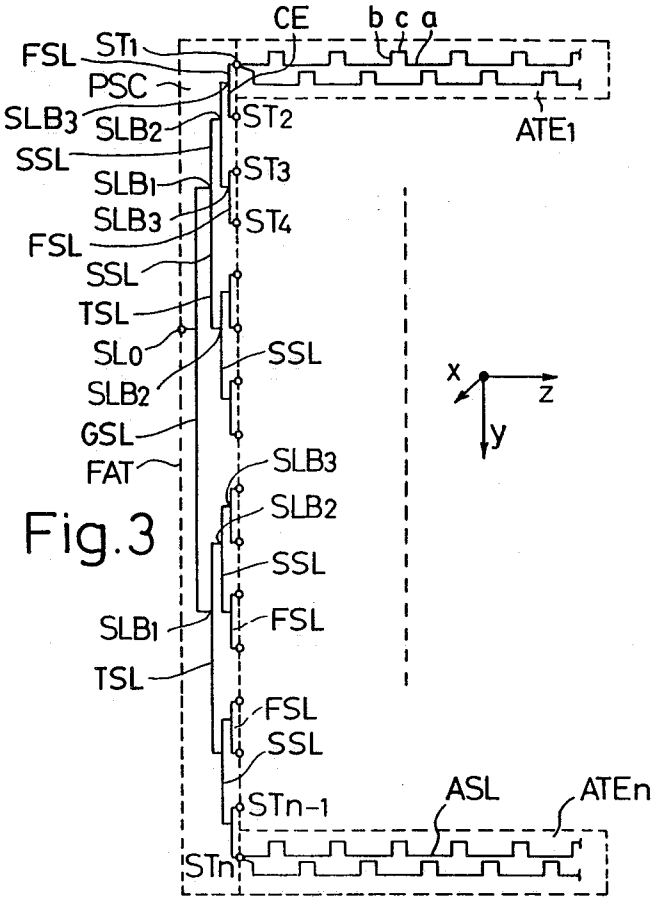
FIG. 3 is a plan view showing a pattern of a major part in an embodiment of a microwave plane antenna of micro-strip lines according to the present invention.

Referring to FIG. 3, there is shown a microwave plane antenna FAT of micro-strip lines. That is a plurality of antenna elements $ATE_1$ to $ATE_n$ are arranged substantially in parallel rows. Each of the antenna elements $ATE_1$ to $ATE_n$ comprises a pair of micro-strip lines ASL configured as a pair of out-of-phase square waves, so that a spatial phase difference will be provided for suppressing the grating lobe of the radiation beam and sharpening its directivity. As a result, there can be provided a traveling-wave antenna of single dimensional array which has a frequency characteristic and directivity determined by the frequency of the square-wave shape of the micro-strip lines ASL. These antenna elements are provided on one surface of an insulating substrate having on the other surface a grinding conductor.

The antenna elements $ATE_1$ to $ATE_n$ are connected at one end to a signal feed circuit PSC which comprises strip conductor line SSL running from a main signal inlet end $SL_o$ to an end of each element while being branched to form a corporate feed network of conductors. In the illustrated embodiment, more particularly, the strip line SSL is so branched as to connect the main signal inlet end $SL_o$ through first to third branches $SLB_1$ to $SLB_3$ to respective signal-receiving ends $ST_1$ to $ST_n$ of the antenna elements $ATE_1$ to $ATE_n$, so that the elements will be supplied with an external electric signal through the signal feed circuit PSC.

Branched sections of the strip line SSL of the signal feed circuit PSC are respectively made to have a length sequentially varied while running from the main feed inlet end $SL_o$ to the signal receiving ends $ST_1$ to $ST_n$ of the antenna elements $ATE_1$ to $ATE_n$.

The corporate feed network includes a plurality of first stage lines FSL each of which interconnects the signal-receiving ends of a pair of the antenna elements $ATE_1$ to $ATE_n$. The network also includes a plurality of second stage lines SSL interconnecting a pair of the first stage lines FSL at first branch points $SLB_3$. A pair of third stage lines TSL interconnects a pair of the second stage lines SSL at second branch points $SLB_2$. A fourth stage line GSL interconnects the pair of third stage lines at third branch points $SLB_1$. The fourth stage line GSL forms a signal inlet end $SL_0$ of the network which is to be coupled to a signal source. Each of the first branch points $SLB_3$ is offset from the centers CE of respective first stage lines along an axis y extending perpendicular to the axis z and within the plane y-z. The second branch points are similarly offset from the centers of the respective second stage lines; the third branch points are similarly offset relative to the centers of the third stage lines; and the power supply end $SL_0$ is similarly offset from the center of the fourth stage line. Accordingly, the conductive path from the signal inlet end $SL_0$ to the signal-receiving end $ST_1$ of a first antenna element $ATE_1$ has a length which is different from the length of the conductive path from the signal inlet end $SL_0$ to the signal-receiving end $ST_2$ of a second antenna element of the pair of antenna elements interconnected by the first stage line FSL. Attention is directed to FIG. 4*b* which depicts a length $L_1$ from the signal-receiving end $ST_1$ to the second branch point $SLB_2$ which is different than a length $L_2$ from the signal-receiving end $ST_2$ to that same branch points $SLB_2$. This difference in lengths of conductive paths, which is true for all of the pairs of antenna elements, causes a time lag to occur in required time for supplying the power to the second antenna element $ATE_2$ with respect to that for the first antenna element $ATE_1$. As shown in FIG. 4(*a*), this time lag is equivalent to a shift of the signal receiving end $ST_1$ of the first antenna element $ATE_1$ to a point $ST_1'$, which shift causing the equiphase surfaces of the both elements to be inclined. As a result that the main beam direction is inclined by an angle $\theta$ with respect to the x axis in the x-y plane. Conditions for this inclination of the main beam direction in the x-y plane may be expressed by equations as follows:

$$\beta L_1 + k(L_1 + L_2)\cdot\cos(\pi - \theta) = \beta L_2 + 2n\pi$$

$$\beta(L_2 - L_1) = k(L_1 + L_2)\cdot\cos(\pi - \theta) - 2n\pi (n \neq o, \pm 1, \ldots)$$

wherein $\beta$ is a line phase constant ($2\pi/\lambda g$), k is a spatial phase constant ($2\pi/\lambda o$), $\lambda g$ is a line wavelength, and $\lambda o$ is a spatial wavelength. Accordingly, when the length $L_1$ for the conducting path of the first antenna element $ATE_1$ and the length $L_2$ for the conducting path of the second antenna element $ATE_1$ are determined, the angle $\theta$ will be determined. That is, the main beam direction in the x-y plane can be suitably set by properly setting the entire power supplying strip line lengths for the respective antenna elements $ATE_1$ to $ATE_n$. In other words, the inclination of the main beam direction can be optimumly set within the plane including that of the plane antenna and perpendicular to the lengthwise axis of the antenna elements, for achieving the maximum signal reception gain. As a result, any reduction in the reception gain can be suppressed even when the signal waves from the broadcasting satellite BS are not perpendicular to the plane antenna in the x-y plane as shown in FIG. 2(*b*) or 2(*c*), and the setting of the main beam direction in both of the x-z and x-y planes can be made possible, that is, the directivity of the plane antenna can be set three-dimensionally, so as to remarkably increase the signal reception gain of the plane antenna, rendering it to be utilizable in an expanded area.

In the above embodiment, the length of the of the signal feed circuit PSC has been described as being increased gradually to be longer as the last antenna element $ATE_n$ is approached. However, this increasing may be made in reverse direction, so as to be increased gradually from the antenna element $ATE_n$ toward the antenna element $ATE_1$, in accordance with the incident angle of the received waves. Further, the number into which the strip line SSL is branched, that is, the number of the network stages, may be properly increased depending on an increase in the number of the antenna elements.

Figure 5:
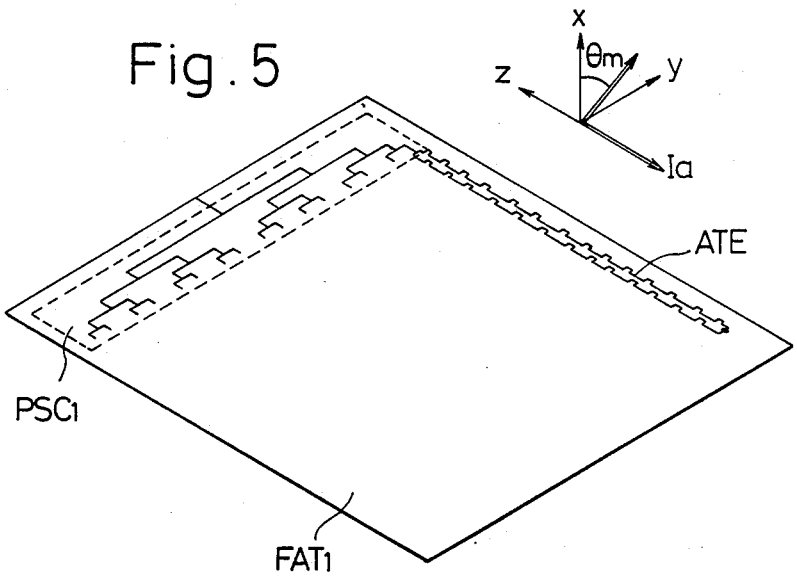
FIG. 5 is a perspective view showing a pattern of one of the paired micro-strip antenna parts of the microwave plane antenna in another embodiment of the present invention.
Figure 6:
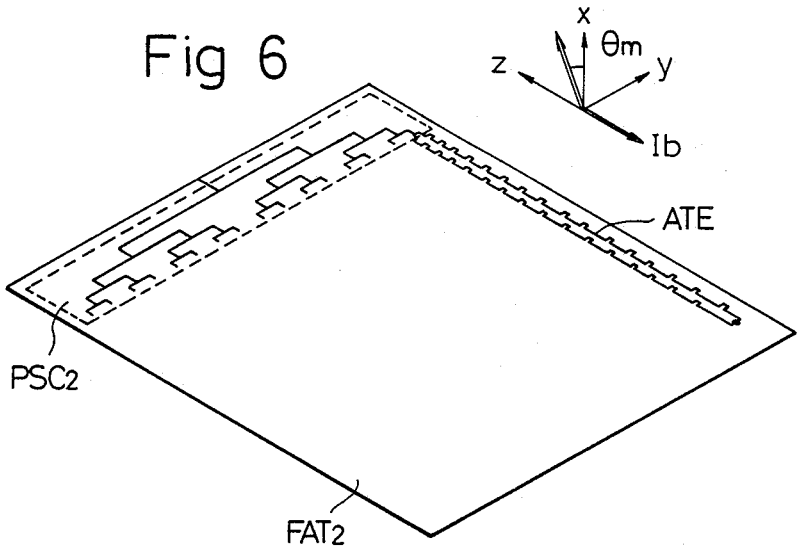
FIG. 6 is a perspective view showing a pattern of the other micro-strip antenna parts in the embodiment of FIG. 5.

Referring next to FIGS. 5 to 7, there is shown a microwave plane antenna in another embodiment of the present invention, in which a pair of plane antennas $FAT_1$ and $FAT_2$ are axially symmetric with respect to a line L which is oriented perpendicular to the lengthwise direction of the antenna elements, that is, to the z axis. The paired plane antennas $FAT_1$ and $FAT_2$ include a pair of the signal feed circuits $PSC_1$ and $PSC_2$ and a pair of rows of the antenna elements ATE (only one of which element is shown in FIG. 5 or 6) respectively forming the micro-strip line antenna. In this case, each of the signal feed circuits $PSC_1$ and $PSC_2$ is disposed in a space between the sets of antenna elements includes conductive strip line branched to form an ordinary corporate feed network without such improvement as in the signal feed circuit PSC of FIG. 3, for supplying a power to the respective antenna elements in the both antennas $FAT_1$ and $FAT_2$ at the same amplitude and phase and in parallel relation.

In the plane antenna $FAT_1$, as shown in FIG. 5, the rows of the antenna elements ATE are arranged so that the main beam direction is inclined in the x-z plane by an angle $\theta_m$ with respect to the x axis in a direction in which a traveling wave current $I_a$ flows, so that the plane antenna $FAT_1$ will form a so-called advancing wave side looking antenna. On the other hand, in the plane antenna $FAT_2$ as shown in FIG. 6, the antenna elements ATE are arranged so that the main beam direction will be inclined also in the x-z plane by the angle $\theta_m$ with respect to the x axis but in a direction opposite to a direction in which a traveling wave current $I_b$ flows, so that this plane antenna $FAT_2$ will form a so-called retrograding wave side looking antenna. Since the main beam directions of the both plane antennas $FAT_1$ and $FAT_2$ are inclined mutually in opposite directions by the same angle, their main beam directions, i.e., their directivities are made to coincide with each other in their composite state, and the directivity is not adversely influenced by the increase of the rows of the antenna elements to be doubled for raising the signal reception gain.

Further, in the embodiment of FIGS. 5 to 7, in particular, the paired signal feed circuits $PSC_1$ and $PSC_2$ are coupled to each other at their common main signal feed end $SL_o$ as disposed to oppose in close proximity to each other in axial symmetry, so that the length of the strip line forming the main signal inlet end $SL_o$ for the both signal feed circuits $PSC_1$ and $PSC_2$ can be minimized and thus the loss of the signal feed circuits $PSC_1$ and $PSC_2$ can be made negligibly small. According to the present embodiment, the signal reception gain has been shown experimentally to have been increased by about 3 dB, whereby the plane antenna can be remarkably improved in the signal reception gain for allowing its utility to be widely practiced.

In the present invention, further, a variety of design modifications may be made. Just as an example, the arrangement explained in connection with FIGS. 3 and 4 may be combined with the arrangement of FIGS. 5 to 7 to provide a plane antenna which attains a signal reception gain improvements to such an extent that the signal reception efficiency of the plane antenna can be made closer to that of the parabolic antenna.

What is claimed as our invention is:

1. A microwave plane antenna comprising:

a first plane antenna part for receiving circularly polarized waves and including a first plurality of antenna elements arranged in parallel rows extending in a first direction, each antenna element of said first plurality of antenna elements including a pair of microstrip conductor lines configured as a pair of out-of-phase square waves for receiving a first main beam, a second plane antenna part for receiving said circularly polarized waves and including a second plurality of antenna elements arranged in parallel rows extending in a second direction opposite said first direction, each antenna element of said second plurality of antenna elements including a pair of microstrip conductor lines configured as a pair of out-of-phase square waves for receiving a second main beam, each of said first and second plane antenna parts further including a corporate feed network connected to signal-receiving ends of the respective plurality of antenna elements, said rows of antenna elements of said first antenna part being parallel to corresponding said rows of antenna elements of said second antenna part and spaced therefrom to form a space therebetween in which said corporate feed networks of said first and second antenna parts are disposed, said corporate feed networks being arranged in axial symmetry relative to an imaginary line extending centrally through said space perpendicular to said first and second directions, said first main beam having an inclination in the same direction as said first direction in which said antenna elements of said first antenna extend and a traveling wave current flows through the elements from said corporate feed network, said second main beam having an inclination in a direction opposite to said second direction in which said antenna elements of said second antenna part extend and a traveling wave current flows through the elements from said corporate feed network, said main beams of the first and second plane antenna parts being parallel in inclination relative to each other and defining a composite main beam.

2. A plane antenna according to claim 1, wherein said composite main beam direction is a composite of first and second main beam directions, said first main beam direction being received by said first plane antenna part and lying in a plane defined by a first axis disposed perpendicular to said plane antenna and a second axis disposed parallel to said antenna elements, said first main beam direction being inclined relative to said first axis toward a direction in which a traveling wave current flows to form a first angle relative to said first axis, said second main beam direction being received by said second plane antenna part and lying in said plane defined by said first and second axes and forming the same angle with said first axis as said first main beam direction except in the opposite direction.

* * * * *